United States Patent [19]

Hammonds

[11] 4,163,583

[45] Aug. 7, 1979

[54] PNEUMATIC HOPPER OUTLET CAP LATCH

[75] Inventor: James C. Hammonds, St. Charles, Mo.

[73] Assignee: ACF Industries, Incorporated, New York, N.Y.

[21] Appl. No.: 844,666

[22] Filed: Oct. 25, 1977

[51] Int. Cl.[2] ..... B61D 7/02; B61D 7/28; B61D 49/00; B65G 53/50

[52] U.S. Cl. ..... 406/198; 105/283; 222/545

[58] Field of Search ..... 105/283, 366 R; 222/545; 302/52; 251/305

[56] References Cited

U.S. PATENT DOCUMENTS

| | | | |
|---|---|---|---|
| 1,252,810 | 1/1918 | Kirchner | 105/366 R |
| 3,167,222 | 1/1965 | Koranda | 302/52 X |
| 3,306,675 | 2/1967 | Fritz | 302/52 |
| 3,583,768 | 6/1971 | Koranda | 302/52 |
| 3,693,846 | 9/1972 | Schuller | 302/52 X |
| 3,980,212 | 9/1976 | Aller et al. | 302/52 X |
| 4,062,596 | 12/1977 | Kull | 302/52 |
| 4,114,785 | 9/1978 | Dugge | 222/545 |

*Primary Examiner*—Stephen G. Kunin
*Assistant Examiner*—Howard Beltran
*Attorney, Agent, or Firm*—Henry W. Cummings

[57] ABSTRACT

A pneumatic hopper outlet, where the discharge conduit end cap is held in place with at least one large headed bolt which is pivotably mounted on the discharge conduit and which engages at least a portion of the end cap. The large headed bolt is attached to a vertically extending locking member of generally inverted J shape which is rotatably mounted on a side of the discharge conduit. When an operating handle attached to an operating shaft of an outlet valve element is in the position which corresponds to the fully closed position of the valve element, the lower surface of the locking member prevents movement of the operating handle and the valve element from moving from the closed position. If the valve element and its operating shaft are not in the fully closed position, the operating handle obstructs the path of the pivoting locking member and the large headed bolt cannot be pivoted into position to hold the end cap in closed position. Preferably a pair of locking members are provided on each end of the outlet, each attached to a large headed bolt which engages a portion of the end cap.

7 Claims, 6 Drawing Figures

PNEUMATIC HOPPER OUTLET CAP LATCH

BACKGROUND OF THE INVENTION

U.S. Pat. No. 3,693,846 discloses utilizing arms extending transversely in opposite directions from the discharge conduit end cap bails, to insure that the operating shafts for longitudinally spaced outlet valve elements in the outlet are in the closed position when the end cap is applied to the discharge tube. U.S. Pat. No. 3,980,212 discloses an angle mounted upon the discharge conduit end wall adapted to engage discs mounted on operating handles to prevent the operating handles from moving out of the stored position while the outlet is in transit. These arrangements increase the cost of the end cap and/or the cost of the end cap ball.

In U.S. Pat. No. 4,114,785 issued Sept. 19, 1978 assigned to the same assignee as the present application, a protrusion is formed on the upper inner edge of the end cap. When the end cap is applied, the operating handles obstruct the path of the protrusion unless the valve elements and operating handles are in the fully closed position.

SUMMARY OF THE INVENTION

The object of the present invention is to provide a simple and economical hopper outlet end cap arrangement which insures that when the end cap is applied to the discharge conduit, an outlet valve element controlling lading flow into the discharge conduit will be in the fully closed position.

In accordance with the present invention in a hopper outlet, the discharge conduit end cap is held in place with at least one large headed bolt which is pivotably mounted on a side of the discharge conduit, and which engages at least a portion of the end cap. The large headed bolt is attached to a vertically extending locking member of generally inverted J shape which is rotatably mounted on the side of the discharge conduit. When an operating handle attached to an operating shaft of the valve element is in the position which corresponds to the fully closed position of the valve element, the lower surface of the locking member prevents movement of the operating handle and the valve element from moving from the closed position. If a valve element and its operating shaft are not in the fully closed position, the operating handle obstructs the path of the pivoting locking member and the large headed bolt cannot be pivoted into position to hold the end cap in closed position. Preferably a pair of locking members are provided on each end of the outlet, each attached to a large headed bolt which engages a portion of the end cap.

THE DRAWINGS

FIG. 1 is a perspective view of a prior art pneumatically discharging hopper outlet constructed according to the teachings of U.S. Pat. No. 4,114,785 issued Sept. 19, 1978 referred to hereinbefore;

DESCRIPTION OF PRIOR ART

Figure 4:
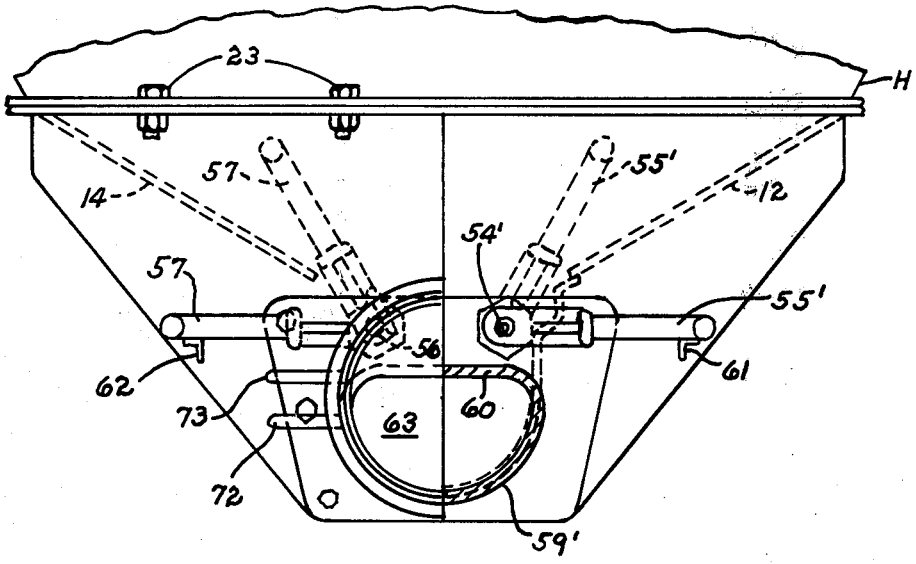
FIG. 4. PRIOR ART
FIG. 4 is an end view looking in the direction of the arrows along the line 4—4 in FIG. 1.

A hopper discharge outlet is shown in the drawings at 10. The outlet includes side walls 12 and 14, and end walls 16 and 18. A flange portion 20 is provided having openings 22 to receive fasteners 23 to attach the outlet of a hopper H (FIG. 4).

Longitudinally spaced valve elements 24 and 26 are provided in openings 28 and 30 defined by the lower inner edges 32, 34 and **32*a*, 34*a* of side walls 12 and 14. A discharge conduit 35 (FIG. 2) extends longitudinally of the outlet. Opening 30, inner edges 32*a* and 34*a*, and valve element 26 are slightly laterally spaced from inner edges 32, 34, opening 28 and valve element 24. A transverse formed plate 36 divides the outlet longitudinally into two compartments 37 and 38**.

Valve elements 24 and 26 are described in greater detail in U.S. Pat. No. 4,114,785 issued Sept. 19, 1978 which is hereby incorporated into the present application by this reference.

Each of the valve elements 24 and 26 are constructed the same, so only one will be described.

Figures 1, 2:
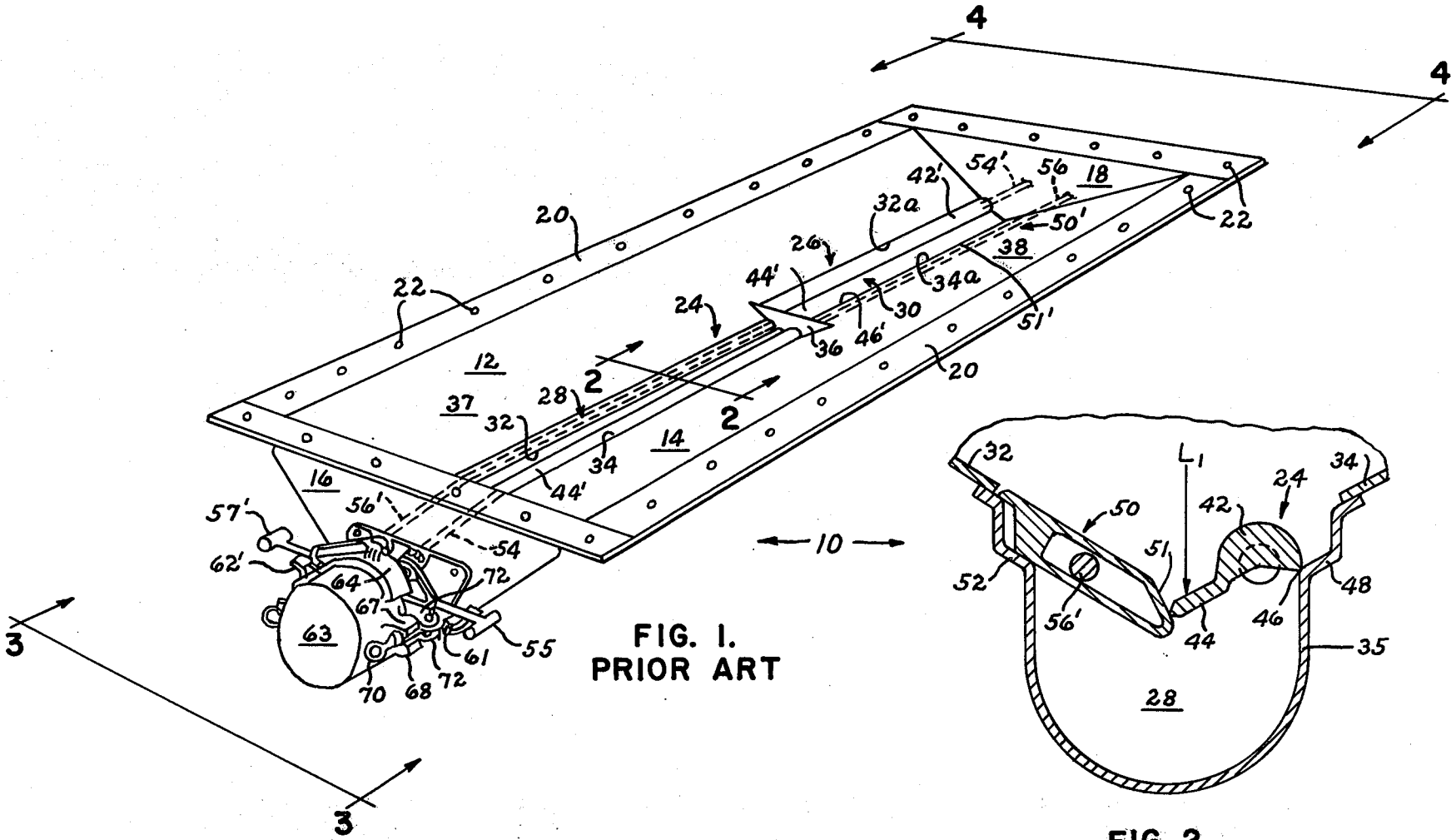
FIG. 1. PRIOR ART
FIG. 2. PRIOR ART
FIG. 2 is a sectional view looking in the direction of the arrows along the line 2—2 in FIG. 1.

Briefly as shown in FIG. 2, valve element 24 includes a body portion 42 which may be a segment of a circle, and a moment portion 44 extending outwardly and eccentrically from the body portion 42. Body portion 42 includes an edge 46 which in closed position seats on a valve seat 48 formed on discharge conduit 35. Moment portion 44 seats on inclined portion 51 of valve seat 50 also located within opening 28, mounted on shoulder 52 of discharge conduit 35.

Valve element 26 includes a body portion 42' having an edge 46' which seats on shoulder 52, and a moment portion 44' which seats on valve seat 50' mounted on shoulder 48.

As is described in greater detail in said U.S. Pat. No. 4,114,785 the lading $L_1$ (FIG. 2) acting on respective moment portions 44 and 44' creates a moment $M_1$ about respective body portions 42, 42' to facilitate moving the valve elements 24 and 26 to the open position. When valve elements 24 and/or 26 are in the open position lading can flow into a discharge conduit 35. Valve elements 24 and 26 are also each movable into a metering position in which edges 46 and 46' are spaced from respective valve seats 48, 52, while moment portion 44, 44' remains in engagement with or close to inclined portions 51, 51', as described in greater detail in said U.S. Pat. No. 4,114,785.

Each of the valve elements 24 and 26 have shafts attached thereto 54 and 54' which extend through the respective rear end walls 16 and 18 and shafts 56, 56' which extend through formed plate 36 and through hollow valve seats 50, 50', through the respective far end walls 18 and 16.

Figure 3:
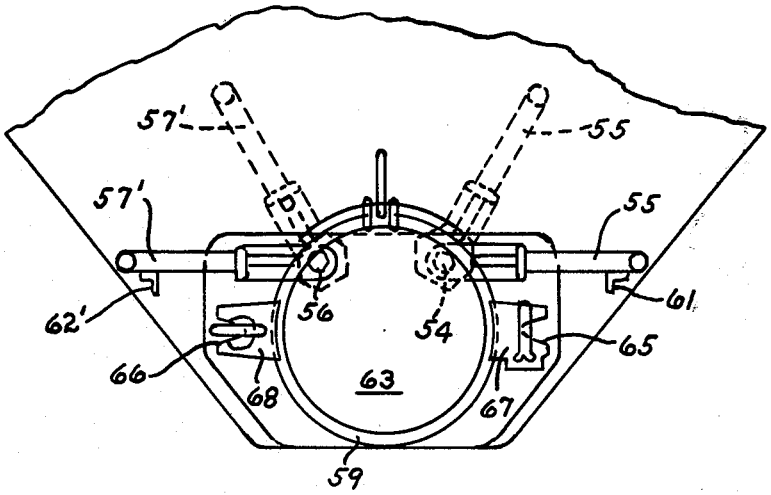
FIG. 3. PRIOR ART
FIG. 3 is an end view looking in the direction of the arrows along the line 3—3 in FIG. 1.
Figure 6:
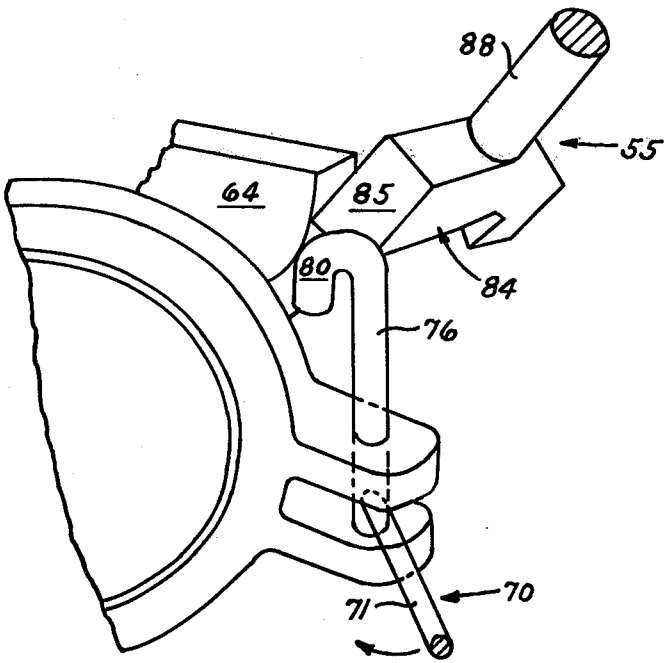
FIG. 6 is a perspective view similar to FIG. 5 illustrating the operating handle in an open position, providing an obstruction for the locking member.

Each of the shafts 54, 54', 56 and 56' are provided with operating handles 55, 55' and 57, 57' (FIGS. 1, 3 and 4). The opposite end portions 59 and 59' of the discharge conduit 35 are foreshortened as indicated at 60 in FIG. 4 below the exit points of shafts 54, 54', 56 and 56' so that handles 55, 55', 56 and 56' can be rotated from the closed position shown in solid lines in FIGS. 3 and 4 engaging respective stops 61, 61', 62 and 62', into the open position shown in dotted lines and thus move valve elements 24 and 26 into the open position and the partly open (metering) position described in U.S. Pat. No. 4,114,785.

End caps 63 are provided to cover the respective end portions 59 and 59' of discharge conduit 35. In the construction shown in U.S. Pat. No. 4,114,785 a lug 64 is welded to end caps 63 whereby if the handles 55, 55', 57 and 57' are not in the fully closed position the end cap 63 cannot be applied. Protrusion 64 will abut one or other of the handles as the cap is applied if they are not in the fully closed position. End cap 63 is held in place by slots 65, 66 provided in respective lugs 67 and 68 provided on either side of each end cap. Large headed bolts 70 are mounted on opposite sides of discharge conduit end portions 59, 59' by means of vertically spaced lugs 72 and 73 welded to formed integrally with the discharge conduit. Bolts 70 include a large head such as an eye head **70*a* and a shank portion 71 which is externally threaded at 71*a***.

DESCRIPTION OF PREFERRED EMBODIMENT

In accordance with the present invention a locking member 74 (FIG. 5) extends within openings **72*a* and 73*a*. Locking member 74 includes a lower portion 75 having a generally horizontal opening 75*a* which is internally threaded to receive threaded shank portion 71*a*, and an upper locking portion 76 extending above lug 73. Locking portion 76 is formed generally in an inverted J shape 80 having a lower, generally horizontal surface 82**.

Handles 55, 55', 57, and 57' each include an inner portion 84 having a vertical surface 85 and a horizontal surface 86 located below surface 82 of locking portion 80 when the handle is in the horizontal position which corresponds to the fully closed position of valve element 24 or 26. Each of handles 55, 55', 57 and 57' includes a shank portion 88 and a gripping portion 90. These handles further include a longitudinally extending inclined portion 91 which is inclined upwardly at 92 and a short transverse portion 94 having an opening 96 through which the respective shaft 54, 54', 56 and 56' passes, held in place with a nut 98.

Figure 5:
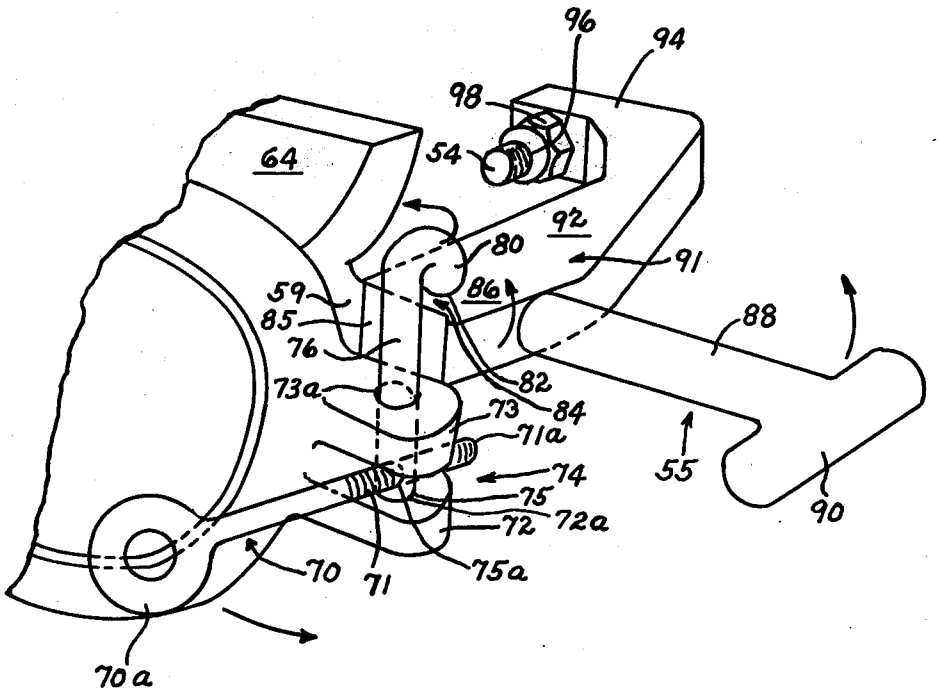
FIG. 5 is an enlarged perspective view of the end cap locking arrangement of the present invention wih the end cap removed, illustrating an operating handle in closed position and a locking member preventing movement of the operating handle from the closed position.

In operation, FIG. 5 shows the position of the handle 55 in the closed position with the lower surface 82 of locking portion 80 above surface 84 of handle 55, preventing rotation of handle 55 from the closed position. Large headed eye portion **70*a* passes through slot 65 and holds cap 63 in the closed position engaging lug 67 on discharge conduit end portion 59**.

If one of the handles 55 or 55', 57 or 57' is left in an open or partially open position, and the operator attempts to pivot bolts 70 into the closed position, handle portion 84 provides an obstruction for the locking portion 80 of locking member 74. Locking portion 80 will abut vertical surface 85 of handle portion 84, thus preventing the bolt 70 from assuming the closed position within the end cap slot 65 and/or 66.

To remove cap 63 to unload the lading, bolt 70 is rotated in the counterclockwise direction in FIG. 5 until bolts 70 are located out of slot 65 and/or 66 (FIG. 3) which also rotates locking portion 80 in the counterclockwise direction away from handle portion 84. A large headed bolt passes through slot 66 on the opposite side of the discharge conduit and its associated locking member pivot in the clockwise direction to remove cap 63. A pair of large headed bolts may also be located on the opposite end of the outlet covering discharge conduit portion 59, one or both provided with locking members constructed in the same manner as locking member 74.

The lading can thus be unloaded by moving handles 55, 57' and/or 55', 57 to the open position shown in dotted lines in FIGS. 3 and 4 to move valve elements 24 and 26 to the open position and/or metering position as described in greater detail in U.S. Pat. No. 4,114,785.

After the lading has been unloaded the handles 55, 55', 57 and 57' are returned to the horizontal position shown in solid lines in FIGS. 3–5. End caps 63 are again placed over discharge conduit end portions 59, 59'. If all the handles have been properly returned to the closed, horizontal position, large head bolts 70 can be pivoted to the position shown in FIG. 5 overlying handle portion 84. In transit handles are maintained in the closed position by lower surface 82 of locking portion 80.

Lug portion 64 may be provided on caps 63 as a secondary stop against the handles moving from the closed position in the event locking portion 80 is broken off in transit. However it is believed that this is sufficiently unlikely to occur that the expense of providing lugs 64 on caps 63 may be dispensed with.

What is claimed is:

1. A hopper outlet comprising: hopper outlet walls extending downwardly having inner ends which define a discharge opening; a discharge conduit extending below said discharge opening; at least one valve element located within said discharge opening being movable between a first position closing said discharge opening, and a second position allowing communication between said discharge opening and said discharge conduit; said valve element having an operating shaft extending generally parallel to said discharge conduit; said shaft having an operating handle located outside of said hopper walls; said discharge conduit having an end cap covering said discharge conduit; said end cap held in place with at least a pair of transversely spaced, large headed bolts pivotably mounted adjacent said discharge conduit and which engage at least a portion of said end cap; at least one of said large headed bolts being attached to a vertically extending locking member rotatably mounted on a side of said discharge conduit; said locking member being movable with said large headed bolt; said locking member having an upper locking portion of generally an inverted "J" shape; said upper locking portion having a lower locking surface adjacent to and overlying said operating handle when said handle is in the position which corresponds to the fully closed position of said valve element, whereby said locking surface prevents movement of said operating handle and said valve element from the closed position; and whereby if said valve element and its operating shaft are in an open position, said operating handle provides an obstruction for said locking member and prevents said locking member from assuming a position overlying said operating handle, and said one large headed bolt is prevented from pivoting into a position to hold the end cap in closed position.

2. A hopper outlet according to claim 1 wherein said outlet includes a pair of valve elements longitudinally spaced from each other, and wherein each valve element has an operating shaft attached thereto extending generally parallel to said discharge conduit, and wherein each operating shaft includes an operating handle extending outside of said hopper walls and includes a portion extending generally transversely away from the discharge conduit and wherein a pair of large headed bolts are respectively attached to locking members of generally inverted "J" shape which respectively are located adjacent to and which overlie said handles when in closed position to prevent the handles and valve elements from moving from the closed position when said end cap is in place, and whereby if one of said valve elements is in open position, its operating handle will provide an obstruction, preventing said locking member from assuming a position overlying said handle, and its respective large headed bolt is prevented from pivoting into position to hold the end cap in closed position.

3. A hopper outlet according to claim 1 wherein said large headed bolts are eye bolts.

4. A hopper outlet according to claim 1 wherein said bolts are threaded into said locking members and wherein said locking members are mounted within a pair of vertically spaced lugs attached to said discharge conduit.

5. A hopper outlet according to claim 1 wherein said handle includes an inner generally longitudinal portion having a generally vertical surface and a generally flat horizontal surface which is located below said locking member in closed position, and which longitudinal portion in open position blocks rotational movement of said locking member.

6. A hopper outlet according to claim 3 wherein said vertical surface in open position blocks rotational movement of said locking member.

7. A hopper outlet comprising: an outlet wall portion extending downwardly having an inner end portion which defines a discharge opening; a discharge conduit extending below said discharge opening; at least one valve element located within said discharge opening being movable between a first position closing said discharge opening, and a second position allowing communication between said discharge opening and said discharge conduit; said valve element having an operating shaft extending generally parallel to said discharge conduit, said shaft having an operating handle extending outside of said hopper wall; said discharge conduit having a pivoted end cap covering said discharge conduit, at least partly held in place with at least one large headed fastener pivotably mounted adjacent said discharge conduit, and engaging at least a portion of said end cap to hold said cap in closed position; said fastener being attached to a generally vertically extending, locking member rotatably mounted on a side of the discharge conduit; said locking member being movable with said fastener, said fastener having a portion located adjacent to and overlying a portion of said operating handle when said handle is in the position which corresponds to the fully closed position of said valve element, said locking member preventing movement of said operating handle and said valve element from moving from the closed position; whereby if said valve element is in open position said operating handle provides an obstruction for said locking member, and said fastener is prevented from pivoting into position to engage the end cap to hold the end cap in closed position.

* * * * *